US007850362B2

(12) United States Patent
Yu

(10) Patent No.: US 7,850,362 B2
(45) Date of Patent: Dec. 14, 2010

(54) REMOVABLE LED LAMP HOLDER WITH SOCKET

(75) Inventor: Jing Jing Yu, El Monte, CA (US)

(73) Assignee: 1 Energy Solutions, Inc., El Monte, CA (US)

( * ) Notice: Subject to any disclaimer, the term of this patent is extended or adjusted under 35 U.S.C. 154(b) by 382 days.

(21) Appl. No.: 12/099,034

(22) Filed: Apr. 7, 2008

(65) Prior Publication Data

US 2009/0027899 A1 Jan. 29, 2009

Related U.S. Application Data

(63) Continuation-in-part of application No. 12/020,373, filed on Jan. 25, 2008, which is a continuation-in-part of application No. 10/984,651, filed on Nov. 10, 2004, now abandoned.

(51) Int. Cl.
*F21V 33/00* (2006.01)

(52) U.S. Cl. ..... 362/647; 362/652; 362/654

(58) Field of Classification Search ..... 362/640.647, 362/652–654, 657–659; 439/699.1, 699.2, 439/680

See application file for complete search history.

(56) References Cited

U.S. PATENT DOCUMENTS

| | | | |
|---|---|---|---|
| 1,694,997 | A | 12/1928 | VanHorn |
| 3,519,913 | A | 7/1970 | Janecek |
| 3,593,038 | A | 7/1971 | Hylten-Cavallius |
| 3,639,822 | A | 2/1972 | Brown |
| 3,758,771 | A | 9/1973 | Frohardt |
| 4,035,681 | A | 7/1977 | Savage |
| 4,074,165 | A | 2/1978 | Moriyama |
| 4,223,248 | A | 9/1980 | Tong |
| 4,298,869 | A | 11/1981 | Okuno |
| 4,316,125 | A | 2/1982 | Noguchi |
| 4,321,598 | A | 3/1982 | Warner |
| 4,329,625 | A | 5/1982 | Nishizawa |
| 4,348,663 | A | 9/1982 | Yanagishima |
| 4,365,244 | A | 12/1982 | Gillessen |
| 4,367,471 | A | 1/1983 | Gillessen |
| 4,396,823 | A | 8/1983 | Nihei |
| 4,492,952 | A | 1/1985 | Miller |

(Continued)

FOREIGN PATENT DOCUMENTS

| | | |
|---|---|---|
| CA | 2342321 | 3/2000 |

OTHER PUBLICATIONS

"Holiday Lighting: Latest Technology Saves Time, Money and More," Burrelle's Yeadon Times, Yeadon, PA, Nov. 29, 2001.

(Continued)

*Primary Examiner*—Laura Tso
(74) *Attorney, Agent, or Firm*—Bridget A. Cochran; William W. Cochran; Cochran Freund & Young LLC

(57) ABSTRACT

Disclosed is an LED lamp assembly that allows an LED lamp to be removably replaced in a lamp holder. A solid, electrical connection is created between the LED pins and electrical terminals as well as connecting wires without soldering. An LED lamp is removably connected to a base that can be inserted in and removed from a socket that is attached to connecting wires. The LED lamp can be removed from the base for replacement of the LED lamp.

6 Claims, 22 Drawing Sheets

U.S. PATENT DOCUMENTS 4,521,835 A 6/1985 Meggs
4,528,619 A 7/1985 Dolan
4,595,920 A 6/1986 Runyan
4,652,981 A 3/1987 Glynn
4,675,575 A 6/1987 Smith
4,727,603 A 3/1988 Howard
4,807,098 A 2/1989 Ahroni
4,839,777 A 6/1989 Janko
4,843,280 A 6/1989 Lumbard
4,857,920 A 8/1989 Kataoka
4,954,822 A 9/1990 Borenstein
4,959,766 A 9/1990 Jain
4,967,330 A 10/1990 Bell et al.
5,087,212 A 2/1992 Hanami
5,130,897 A 7/1992 Kuzma
5,155,669 A 10/1992 Yamuro
5,187,377 A 2/1993 Katoh
5,193,895 A 3/1993 Naruke
5,239,872 A 8/1993 Meyer-Bisch
5,257,020 A 10/1993 Morse
5,313,187 A 5/1994 Choi
5,321,593 A 6/1994 Moates
5,323,305 A 6/1994 Ikeda
5,366,780 A 11/1994 Rapisarda
5,404,282 A 4/1995 Klinke
5,410,458 A 4/1995 Bell
5,436,809 A 7/1995 Brassier
5,457,450 A 10/1995 Deese
5,463,280 A 10/1995 Johnson
5,481,444 A 1/1996 Schultz
5,499,174 A 3/1996 Lin
5,528,484 A 6/1996 Hayashi
5,567,037 A 10/1996 Ferber
5,580,159 A 12/1996 Liu
5,647,759 A 7/1997 Lien
5,649,755 A 7/1997 Rapisarda
5,655,830 A 8/1997 Ruskouski
5,660,560 A 8/1997 Cheng
5,663,719 A 9/1997 Deese
5,670,847 A 9/1997 Lin
5,672,000 A 9/1997 Lin
5,681,107 A 10/1997 Wang
5,720,544 A 2/1998 Shu
5,722,860 A 3/1998 Pan
5,726,535 A 3/1998 Yan
5,762,419 A 6/1998 Yan
5,808,592 A 9/1998 Mizutani
5,887,967 A 3/1999 Chang
5,890,794 A 4/1999 Abtahi
5,936,599 A 8/1999 Reymond
5,941,626 A 8/1999 Yamuro
5,962,971 A 10/1999 Chen
5,969,469 A * 10/1999 Wang ..... 313/318.1
5,988,831 A 11/1999 Pan
6,048,074 A 4/2000 Wang
6,072,280 A 6/2000 Allen
6,079,848 A 6/2000 Ahroni
6,120,312 A 9/2000 Shu
6,183,104 B1 2/2001 Ferrara
6,183,310 B1 2/2001 Shu
6,190,021 B1 2/2001 Huang
6,200,003 B1 3/2001 Tseng
6,227,679 B1 5/2001 Zhang
6,283,797 B1 9/2001 Wu
6,361,198 B1 3/2002 Reed
6,367,952 B1 4/2002 Gibboney
6,461,019 B1 10/2002 Allen
6,478,455 B2 11/2002 Ahroni
6,505,954 B2 1/2003 Chen
6,550,953 B1 4/2003 Takahashi et al.
D474,848 S 5/2003 Lodhie
D474,849 S 5/2003 Lodhie
6,598,996 B1 7/2003 Lodhie
D485,379 S 1/2004 Stekelenburg
6,709,132 B2 3/2004 Ishibashi
6,717,526 B2 4/2004 Martineau
6,739,733 B1 5/2004 Lamke et al.
6,758,578 B1 7/2004 Chou
6,830,358 B2 12/2004 Allen
7,012,379 B1 3/2006 Chambers et al.
7,014,352 B2 3/2006 Wu
7,045,965 B2 5/2006 Yu
7,063,442 B2 6/2006 Sugar
7,066,628 B2 6/2006 Allen
7,066,636 B2 6/2006 Wu
7,118,249 B2 10/2006 Hsu et al.
7,217,005 B2 5/2007 Lin
7,220,022 B2 5/2007 Allen et al.
2002/0043943 A1 4/2002 Menzer et al.
2002/0105438 A1 8/2002 Forbes et al.
2003/0025120 A1 2/2003 Chang
2003/0079387 A1 5/2003 Derose
2003/0147245 A1 8/2003 Chen
2003/0198048 A1 10/2003 Frederick
2004/0135522 A1 7/2004 Berman
2004/0140892 A1 7/2004 Hanood
2004/0190289 A1 9/2004 Liu
2004/0190290 A1 9/2004 Zerphy et al.
2004/0233145 A1 11/2004 Chiang
2005/0057187 A1 3/2005 Catalano
2005/0162851 A1 7/2005 Kazar et al.
2006/0007679 A1 1/2006 Allen
2006/0012349 A1 1/2006 Allen
2006/0012997 A1 1/2006 Catalano
2006/0044788 A1 3/2006 Damrau
2006/0098442 A1 5/2006 Yu
2006/0180822 A1 8/2006 Yu
2006/0203482 A1 9/2006 Allen
2006/0270250 A1 11/2006 Allen
2007/0025109 A1 2/2007 Yu
2007/0064450 A1 3/2007 Chiba et al.
2007/0183153 A1 8/2007 Yu
2008/0013324 A1 1/2008 Yu
2008/0024071 A1 1/2008 Yu
2008/0025024 A1 1/2008 Yu
2008/0143234 A1 6/2008 Yu
2008/0157686 A1 7/2008 Chung et al.

OTHER PUBLICATIONS

"New kind of Christmas lights cut electricity use," Luce Press Clippings, Nevada Appeal, Carson City, NV, Dec. 2, 2001.
www.optics.org, The Online Photonics Resource.
http://ledmuseum.home.att.net/xmas1.htm;www.foreverbright.com.
Christmas may be brighter longer, Huntsville Times, Huntsville, Alabama, Dec. 10, 2001.
"Holiday lights that stay ready for action," News Journal, Wilmington Metropolitan Area, Dec. 17, 2001.
"Bulbs that didn't work spur new line of lights," Richmond, Virginia, Times, Dec. 25, 2001.
"Now, let's eliminate tangles too," Sentinel-Tribune, Bowling Green, Ohio, Dec. 22, 2001.
"LED Christmas lights gaining in popularity," Luce Press, Shamokin, Pennsylvania, Dec. 2, 2001.
"It's beginning to look a lot light Christmas," Luce Press, Democrat, Tallahassee, Florida, Dec. 3, 2001.
"LED lights are Christmas option," Luce Press, Herald News, Joliet, Illinois, Nov. 28, 2001.
"A welcome idea for those who string holiday lights," Luce Press, Times, Seattle, Washington, Nov. 29, 2001.
"LEDing the way," Luce Press, Chronicle, Houston, Texas, Dec. 2, 2001.
". . . malfunctioning yule lights," Desert News, Salt Lake City-Ogden Metro Area, Utah, Dec. 9, 2001.

"LED holiday lights catch on," Luce Press, Herald, Sharon, Pennsylvania, Dec. 2, 2001.
"A brighter day for yule lights," Luce Press, Star, Kansas City, Missouri, Dec. 8, 2001.
"LED Lights Giving Off A Christmas Sparkle," "Entrepreneurs Claim LED Technology Better Than Christmas Bulbs," Luce Press, Tribune, Salt Lake City-Ogden, Utah, Dec. 2, 2001.
"New Christmas lights gaining popularity," Luce Press, Intelligencer, Doylestown, Pennsylvania, Nov. 28, 2001.
"Forever Bright," Luce Press, New Jersey Herald, Newton, New Jersey, Nov. 25, 2001.
"Replacements for traditional Christmas lights gaining popularity," Luce Press, Nov. 28, 2001.
"Inventor lights up Christmas," Luce Press, Valley News Dispatch, Tarentum, Pennsylvania, Nov. 25, 2001.
"The Christmas light man," Luce Press, Dominion Post, Morgantown, West Virginia, Nov. 24, 2001.
"LEDs the coolest thing in holiday lights," Luce Press, Press, Atlantic City, New Jersey, Nov. 25, 2001.
"Consumers switch to LED Christmas lights for their reliability," Luce Press, Star-Gazette, Elmira, New York, Dec. 2, 2001.
"All wrapped up," Luce Press, Ledger, Ellwood City, Pennsylvania, Dec. 1, 2001.
"Beating Christmas burnout," Luce Press, Press Enterprise, Bloomsburg, Pennsylvania, Nov. 26, 2001.
U.S. Appl. No. 09/339,616; Inventor: Tuyet Thi Vo; abandoned.
U.S. Appl. No. 09/378,631, Inventor: Tuyet Thi Vo; abandoned.
Non-final Office Action mailed Feb. 7, 2006 in U.S. Appl. No. 10/984,651, filed Nov. 10, 2004 by Jing Jing Yu.
U.S. Appl. No. 12/020,373, filed Jan. 25, 2008, by Jing Jing Yu.
U.S. Appl. No. 11/716,788, filed Mar. 12, 2007, by Jing Jing Yu.
U.S. Appl. No. 11/860,298, filed Sep. 24, 2007, by Jing Jing Yu.
U.S. Appl. No. 60/949,804, filed Jul. 13, 2007, by Jing Jing Yu.
U.S. Appl. No. 12/098,423, filed Apr. 5, 2008, by Jing Jing Yu.
Non-Final Office Action mailed May 23, 2005, in U.S. Appl. No. 10/767,820, filed Jan. 30, 2004 by Minzhu Li.
Non-Final Office Action mailed Aug. 18, 2008, in U.S. Appl. No. 11/461,293, filed Jul. 31, 2006, by Jing Jing Yu.
Non-Final Office Action mailed May 16, 2008, in U.S. Appl. No. 11/461,293, filed Jul. 31, 2006, by Jing Jing Yu.
Non-Final Office Action mailed Dec. 21, 2007, in U.S. Appl. No. 11/461,293, filed Jul. 31, 2006, by Jing Jing Yu.
Non-Final Office Action mailed Jun. 4, 2007, in U.S. Appl. No. 11/189,066, filed Jul. 26, 2005, by Jing Jing Yu.
Non-Final Office Action mailed Oct. 27, 2008, in U.S. Appl. No. 11/849,939, filed Sep. 4, 2007, by Jing Jing Yu.
Final Office Action mailed Sep. 25, 2008, in U.S. Appl. No. 11/849,939, filed Sep. 4, 2007, by Jing Jing Yu.
Non-Final Office Action mailed Mar. 20, 2008, in U.S. Appl. No. 11/849,939, filed Sep. 4, 2007, by Jing Jing Yu.
Non-Final Office Action mailed Feb. 15, 2007, in U.S. Appl. No. 11/056,148, filed Feb. 14, 2005, by Jing Jing Yu.
Non-Final Office Action mailed Jun. 14, 2007, in U.S. Appl. No. 11/350,343, filed Feb. 9, 2006, by Jing Jing Yu.

* cited by examiner

REMOVABLE LED LAMP HOLDER WITH SOCKET

CROSS-REFERENCE TO RELATED APPLICATION

This application is a continuation-in-part of U.S. patent application Ser. No. 12/020,373, entitled "Removable LED Lamp Holder," by Jing Jing Yu, filed Jan. 25, 2008, which is a continuation-in-part of U.S. patent application Ser. No. 10/984,651, entitled "Removable LED Lampholder," by Jing Jing Yu, filed Nov. 10, 2004. The entire contents of the above mentioned applications are hereby specifically incorporated herein by reference for all that they disclose and teach.

BACKGROUND OF THE INVENTION

Incandescent lights work in a full cycle of sinusoid AC voltage, so there is no concern about their polarities when connecting them to either a DC or an AC power line. An LED light, however, being a diode, conducts current only in one direction, i.e. from its anode side to cathode side. To work properly, an LED light must be connected with a right polarity in a DC power line, where a positive voltage must be applied from anode to its cathode. When an LED is used in an AC circuit, it conducts current only for half cycle of the AC voltage, i.e. only when the AC voltage has a positive voltage offset from the LED anode pin to the LED cathode pin.

When two or more LEDs are connected in series, all LEDs must be connected in a same polarity direction, i.e. the anode of the second LED must be connected to the cathode of the first LED, and the anode of the third LED must be connected to the cathode of the second LED, and so on. Otherwise, no current can flow through the series circuit, if one or more LEDs are connected in an opposite polarity direction with respect to the rest LEDs.

SUMMARY OF THE INVENTION

An embodiment of the present invention may therefore comprise an LED lamp assembly for releasably attaching an LED element to a power connection comprising: an LED element comprising a lamp base having a predetermined shape; a lamp holder having a body portion, the body portion having a lamp holder opening formed in the body portion having a predetermined shape; a socket comprising an extended portion that has a shape that substantially matches the predetermined shape of the opening formed in the body portion of the lamp holder, the socket formed to have a socket opening that has a shape that substantially matches the predetermined shape of the lamp base; two terminal plates disposed on opposite sides of the body portion of the lamp holder; a pair of LED leads that extend through a central opening in the socket that are bent around an outside surface of the extended portion of the socket so that the two LED leads abut against the two terminal plates to make an electrical contact when the socket is inserted in the lamp housing as a result of the extended portion forcing the LED pins in an outward direction against the terminal plates.

An embodiment of the present invention may therefore further comprise a method of releasably connecting an LED element to an AC power source comprising: providing a lamp holder comprising two conductive plates that are connected to the power source and a lamp holder opening having a predetermined shape; providing an LED element that has a predetermined LED shape and two LED leads; providing a socket that has an extended portion having a shape that substantially matches the predetermined shape of the lamp holder opening, and a socket opening having a shape that substantially matches the predetermined LED shape; inserting the LED lamp into the socket so that the predetermined LED shape fits into the socket opening; inserting the LED pins through a central opening in the socket; bending portions of the LED leads that extend from the socket around the outside surface of the extended portion of the socket so that the LED element can be removed from the socket; inserting the extended portion of the socket into the lamp holder opening, the extended portion having a size that forces the LED leads against the conductive plates to create a strong electrical connection while allowing the LED leads to be removed from the socket, the LED leads being forced outwardly by the extended portion in substantially opposite directions against the conductive plates to create an electrical connection while allowing the socket and the LED leads to be removed from the lamp holder.

DETAILED DESCRIPTION OF EMBODIMENTS OF THE EMBODIMENTS

Figure 1:
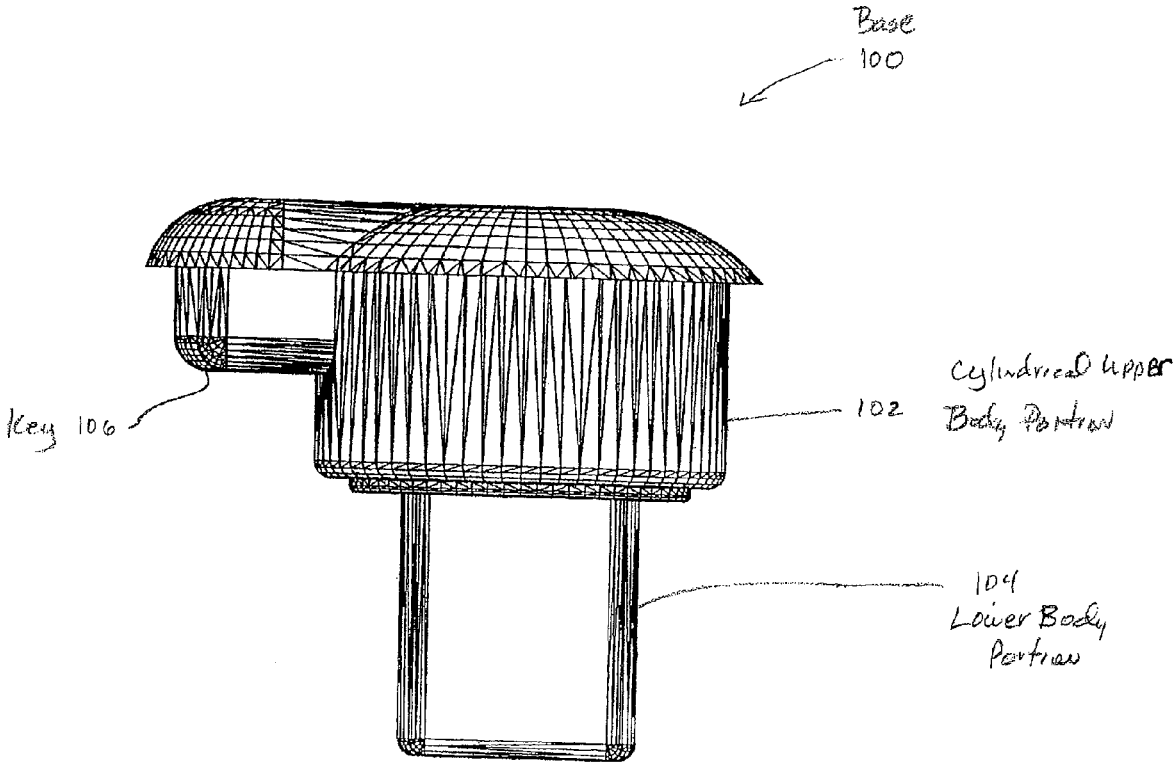
FIG. 1 is a side view of one embodiment of a base of an LED lamp holder.

FIG. 1 is a side view of a base 100 of an LED lamp holder. The base 100 comprises a cylindrical upper body portion 102, a lower body portion 104 and a key 106. Key 106 provides an orientation for the cylindrical upper body portion 102 and the lower body portion 104. Since LED lamps have a polarity that must be maintained with respect to connection of the LED lamp to power supplies and other LEDs, a key 106 is needed to ensure that the LED lamp is connected in the proper orientation to the LED lamp holder and to make sure that the LED lamp holders are connected to one another with the proper orientation.

Figure 2:
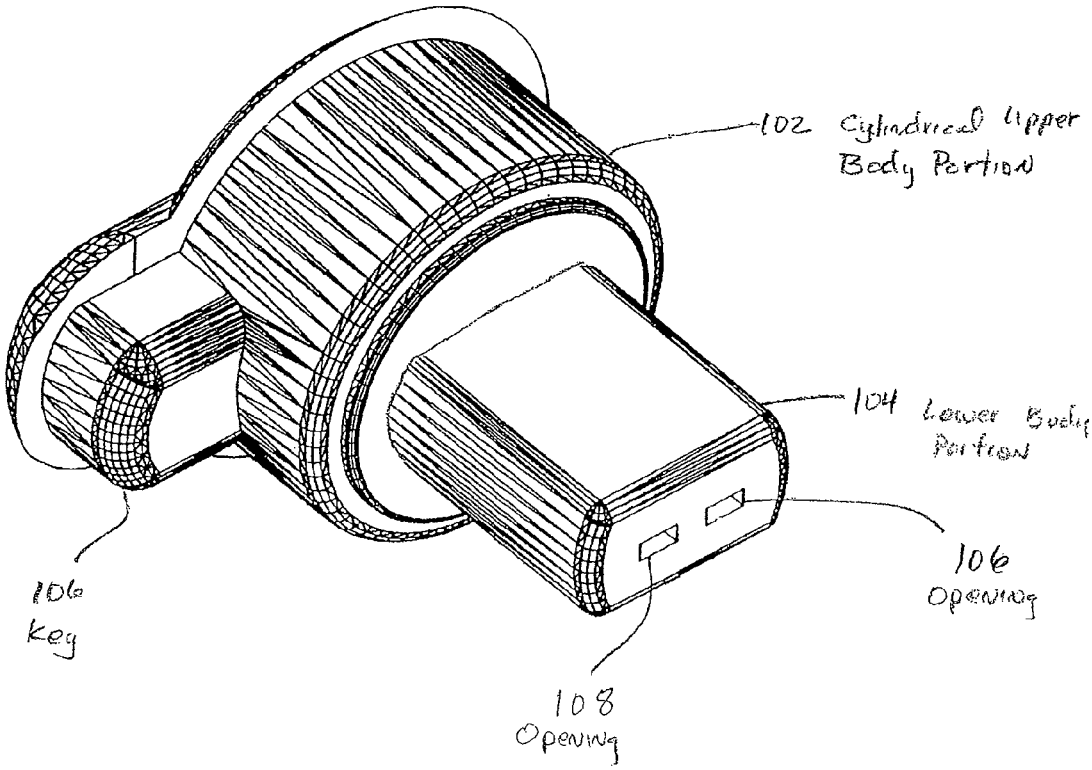
FIG. 2 is a schematic bottom side view of the base illustrated in FIG. 1.

FIG. 2 is a bottom isometric view of the base 100 illustrated in FIG. 1. FIG. 2 illustrates the cylindrical upper body portion 102 and the key 106. As also shown in FIG. 2, the lower body portion 104 has two openings, openings 106 and opening 108. Opening 106 and opening 108 allow the LED cathode pin 504 (FIG. 5) and the LED anode pin 506 (FIG. 5), respectively, to protrude through the bottom of the lower body portion 104. The LED anode pin 506 (FIG. 5) protrudes through opening 108, which is aligned with key 106. Cathode pin 504 (FIG. 5) protrudes through opening 106 when the LED lamp 500 (FIG. 5) is assembled to the base 100, as illustrated in FIG. 6.

Figure 3:
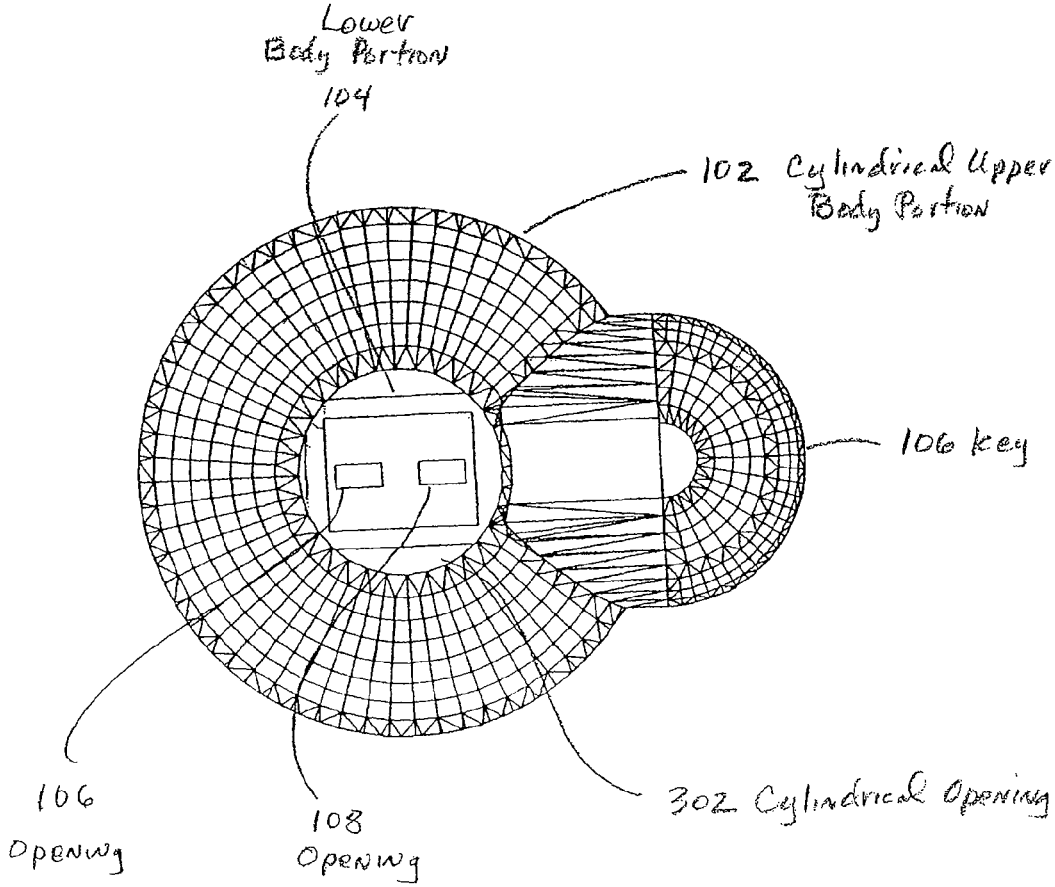
FIG. 3 is a bottom view of the base illustrated in FIG. 1.
Figure 4:
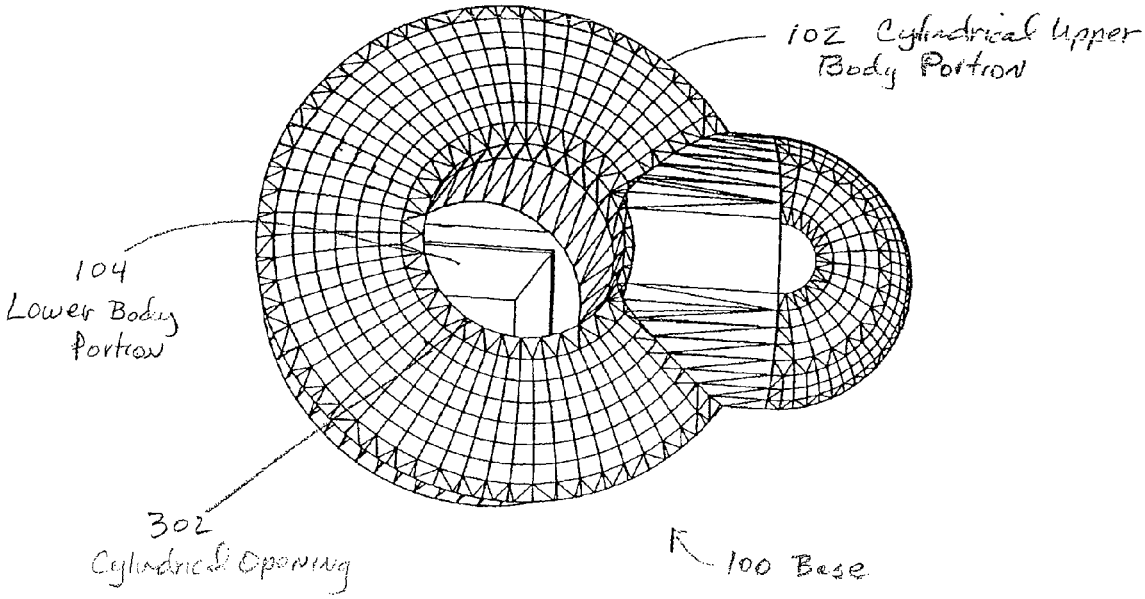
FIG. 4 is a top side view of the base illustrated in FIG. 1.

FIG. 3 is a top view of the base 100 illustrated in FIGS. 1 and 2. As shown in FIG. 3, the base 100 includes a cylindrical upper body portion 102, a key 106, and a lower body portion 104, having openings 106 and 108. FIG. 3 also illustrates the cylindrical opening 302 that is centrally located in the base 100, which results in the cylindrical upper body portion to be shaped as an annulus. FIG. 4 is an isometric top view of the base 100 illustrated in FIGS. 1-3. The base 100 includes the centrally disposed cylindrical opening 302 in the base 100 that causes the base 100 to be shaped as an annulus. The cylindrical opening 302 only extends through the cylindrical upper body portion 102 and stops at the point where the lower body portion 104 is secured to the cylindrical upper body portion 102.

Figure 5:
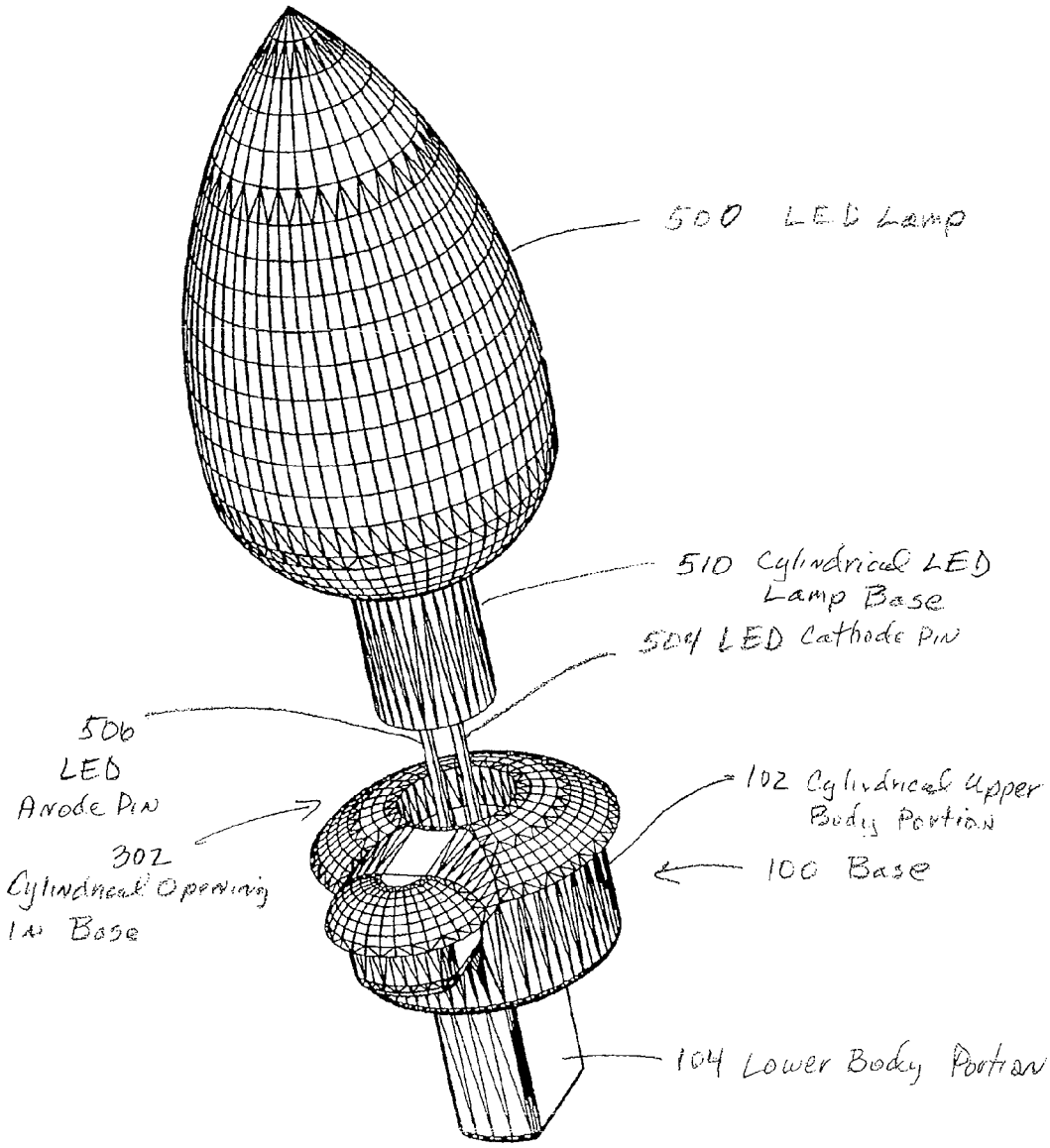
FIG. 5 is an isometric view of the base illustrated in FIG. 1, together with an LED lamp.

FIG. 5 is an isometric view of the base 100 illustrated in FIGS. 1-4 being assembled to an LED lamp 500. As shown in FIG. 5, the LED lamp 500 has a cylindrical LED lamp base 510 that fits into the cylindrical opening 302 in base 100. LED cathode pin 504 and LED anode pin 506 are inserted in and through the cylindrical opening 302 in the base 100, and protrude through openings 106, 108, respectively, in the bottom of the cylindrical LED lamp base 510. During assembly of the LED lamp 500 with the base 100, the LED anode lead 506 is aligned with the key 106 in the base 100. The cylindrical LED lamp base 510 has a length that substantially matches the length of the cylindrical upper body portion 102 of the base 100. The bottom of the cylindrical LED lamp base 510 abuts against the top portion of the lower body portion 104 inside the cylindrical opening 302 in the base 100. In this way, the rounded portion of the LED lamp 500 abuts against the top surface of the cylindrical upper body portion 102 of the base 100. This provides a degree of sealing of the LED lamp 500 to the base 100, so that the assembly of the LED lamp 500 and the base 100 is at least water resistant. In addition, the cylindrical LED lamp base 510 fits tightly within the cylindrical opening 302 to provide further water resistance.

Figure 6:
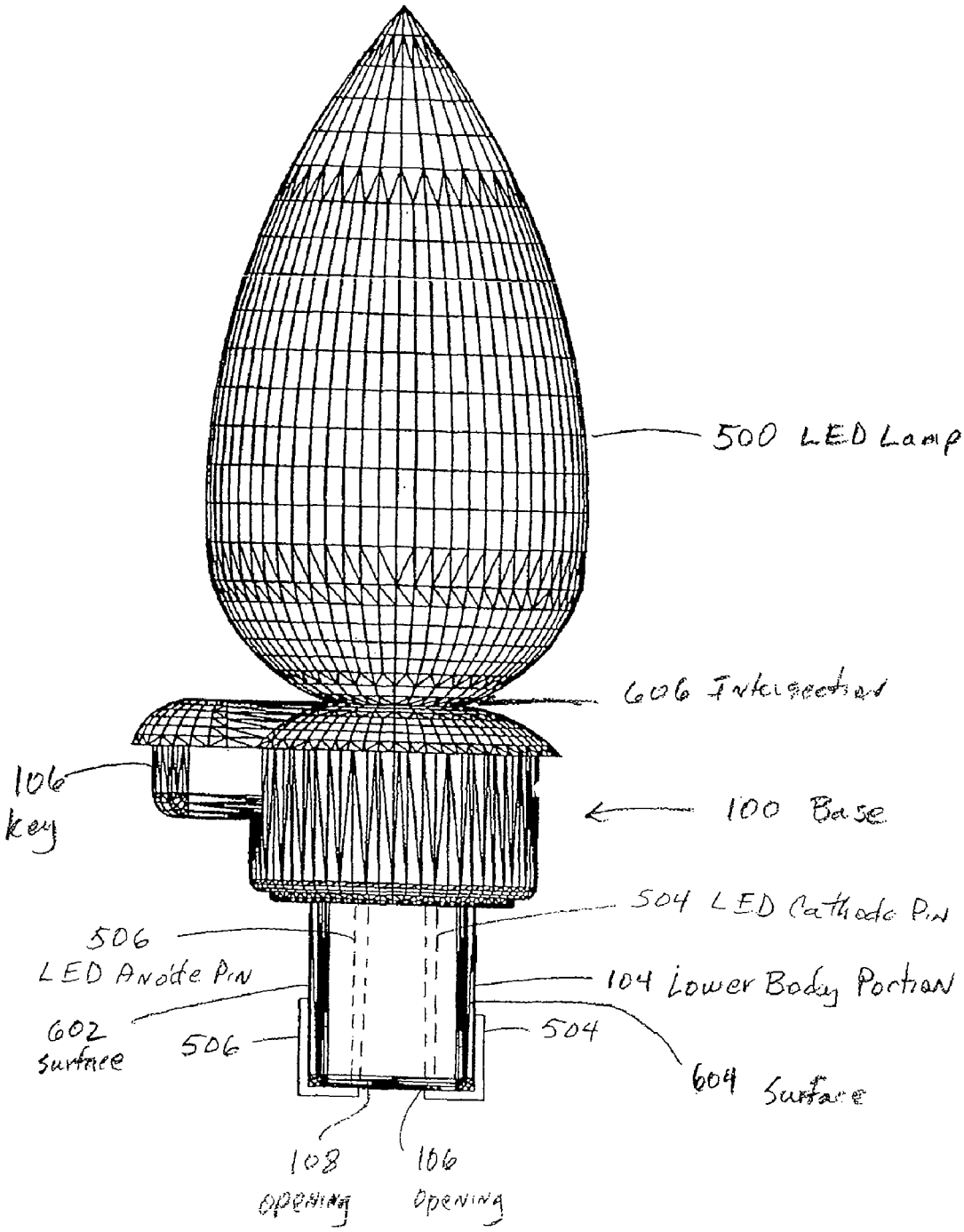
FIG. 6 is a side view of an LED lamp assembled to the base illustrated in FIG. 1.

FIG. 6 is a side view of the LED lamp 500 which is mounted to the base 100. As shown in FIG. 6, the LED anode pin 506 extends through the open area in the lower body portion 104 and protrudes through opening 108. The LED anode pin 506 is then wrapped around the base of the lower body portion 104 and surface 602 on the lower body portion 104. Similarly, LED cathode pin 504 extends through the open area in the lower body portion 104 and through the opening 106 at the base of the lower body portion 104. The LED cathode pin then wraps around the base of the lower body portion 104 and along the surface 604 of the lower body portion 104. The manner in which the LED anode pin 506 and the LED cathode pine 504 are wrapped around the outer surface of the lower body portion 104 assists in holding the LED lamp 500 in the base 100. The LED anode pin 506 is aligned with the key 106 in the base 100. In addition, as mentioned above, the intersection 606 of the LED lamp 500 and the base 100 at least partially seals the LED lamp 500 to the base 100, together with the tight fit of the cylindrical LED lamp base 510 to the cylindrical opening 302 in the base 100, as shown in FIG. 5.

Figure 7:
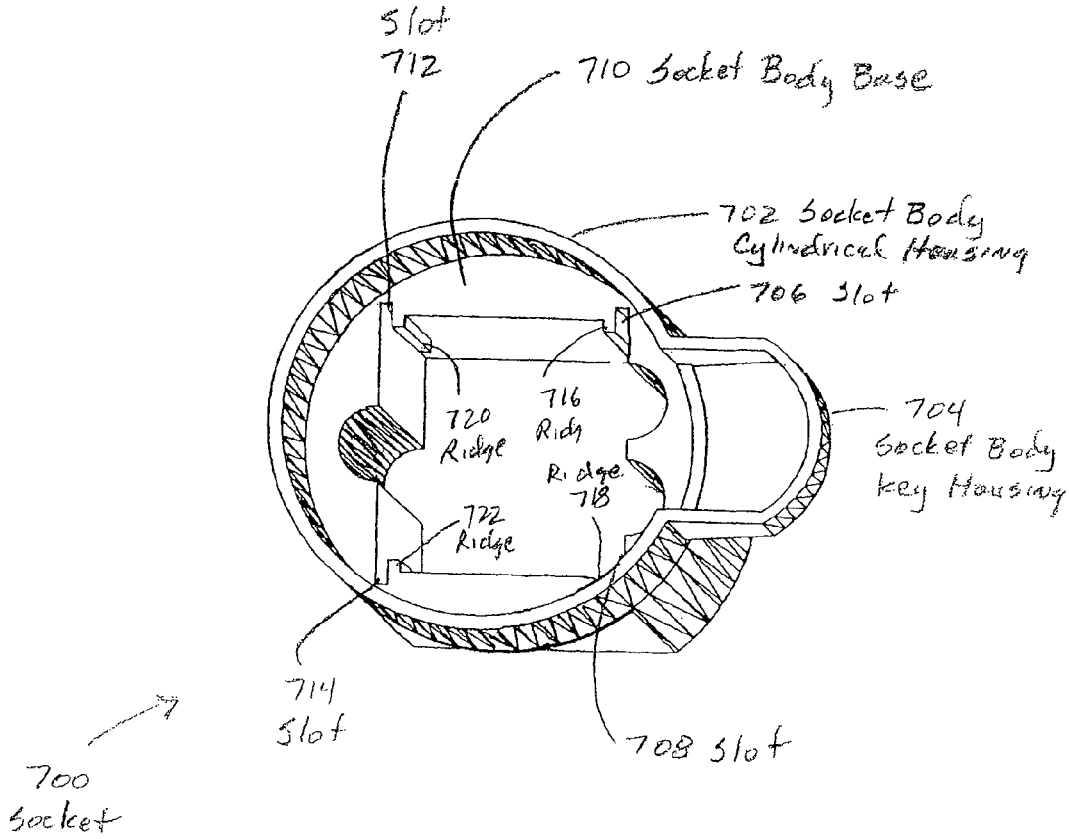
FIG. 7 is a top isometric view of one embodiment of a socket body base.

FIG. 7 is a top isometric view of one embodiment of a socket 700. Socket 700 includes a socket body cylindrical housing 702, which is attached to a socket body base 710. A socket body key housing 704 is attached to the socket body cylindrical housing 702. The socket body cylindrical housing 702 has a shape that allows the cylindrical upper body portion 102 to fit within and seal the base 100 to the socket 700. Similarly, the key 106 fits and is sealed to the socket body key housing 704. The socket body base may be formed in a rectangular configuration as shown in FIG. 7, or other configurations. Slots 706 and 708 are formed along one wall of the rectangular configuration, while slots 712 and 714 are configured along another wall of the rectangular socket body base 710. Ridges 716, 718 are disposed adjacent slots 706, 708, respectively. Similarly, ridges 720, 722 are disposed adjacent slots 712, 714, respectively. These slots 706-714 and the adjacent ridges 716-722 only extend a portion of the length of the socket body base 710.

Figure 8:
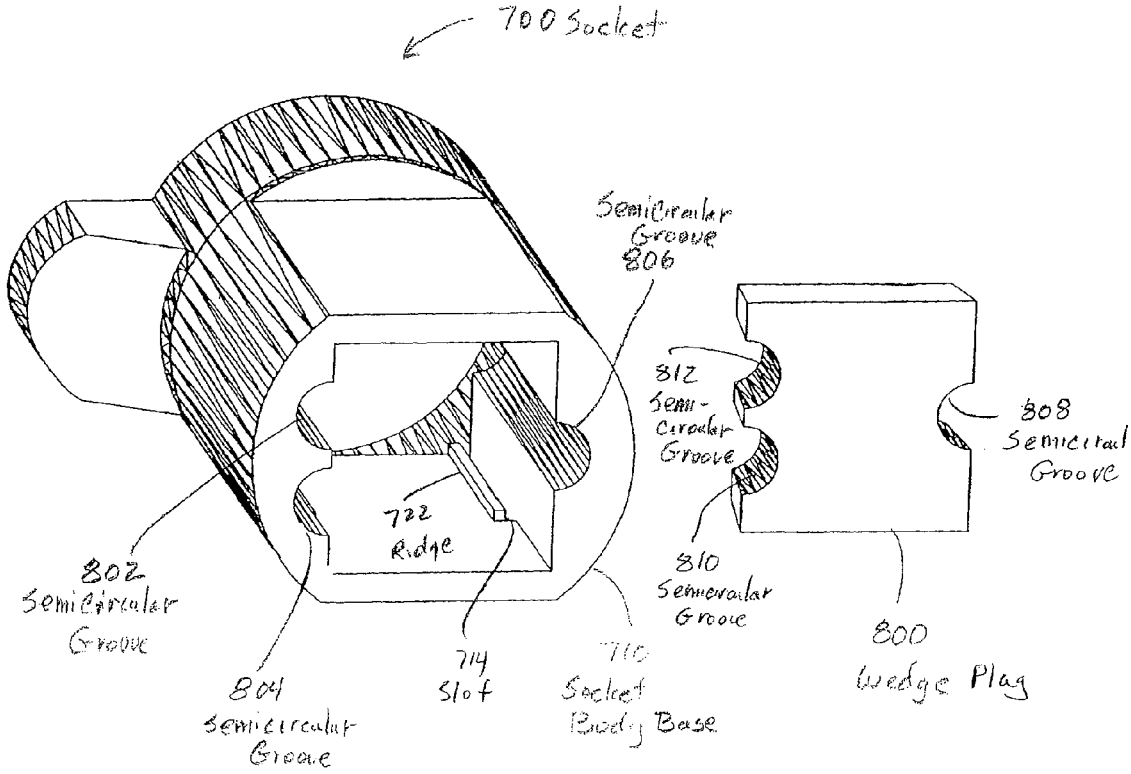
FIG. 8 is a bottom isometric view of the socket body base illustrated in FIG. 7, together with a wedge.

FIG. 8 is an isometric bottom view of the socket 700 illustrated in FIG. 7, together with a wedge plug 800. As shown in FIG. 8, semicircular groove 802 and semicircular groove 804 are formed in a first wall of the socket body base 710. A semicircular groove 806 is formed on an opposing wall of the socket body base 710. FIG. 8 also illustrates the ridge 722 and associated slot 714 that only extend a portion of the length of the socket body base 710, which may form an abutment surface for the wedge plug 800 when inserted in the opening in the socket body base 710. The wedge plug 800 includes a single semicircular groove 808 on one side of the wedge plug 800 and semicircular grooves 810, 812 on an opposite of the wedge plug 800. Semicircular groove 808 matches up with semicircular groove 806 while semicircular grooves 810, 812 match up with semicircular grooves 804, 802, respectively, when the wedge plug 800 is inserted into the socket body base 710. In this manner, circular openings are formed for the passage of wires for connecting the lamp assembly to a power supply.

Figure 9:
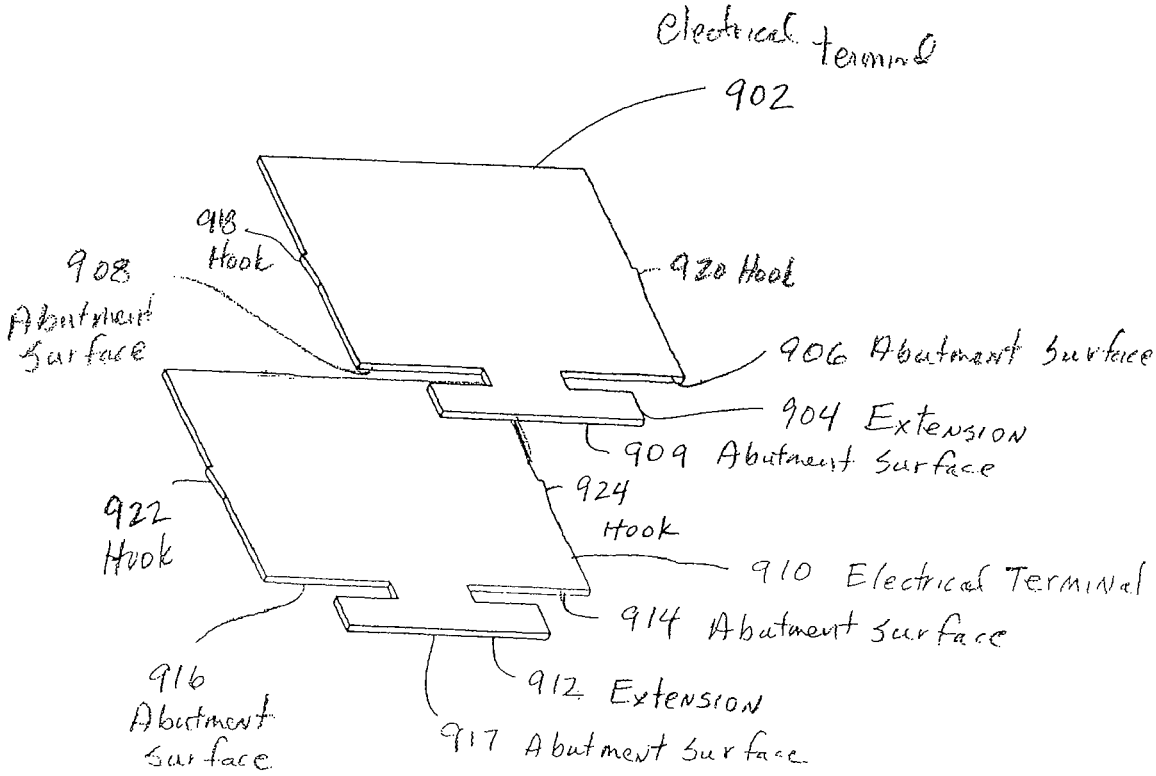
FIG. 9 is an isometric view of one embodiment of two electrical terminals.

FIG. 9 is an isometric view of electrical terminal 902 and electrical terminal 910. Electrical terminal 902 includes an extension 904 having an abutment surface 909. The main body of the electrical terminal 902 has abutment services 906, 908. Similarly, electrical terminal 910 has an extension 912 having an abutment service 917. The main body portion of the electrical terminal 910 includes abutment surfaces 914, 916. Electrical terminal 902 also has hooks 918, 920 along a side edge. Similarly, hooks 922, 924 dispose along side edges of the electrical terminal 910. These hooks function to hold the electrical terminals 902, 910 in position in the slots in the socket body base 710.

Figure 10:
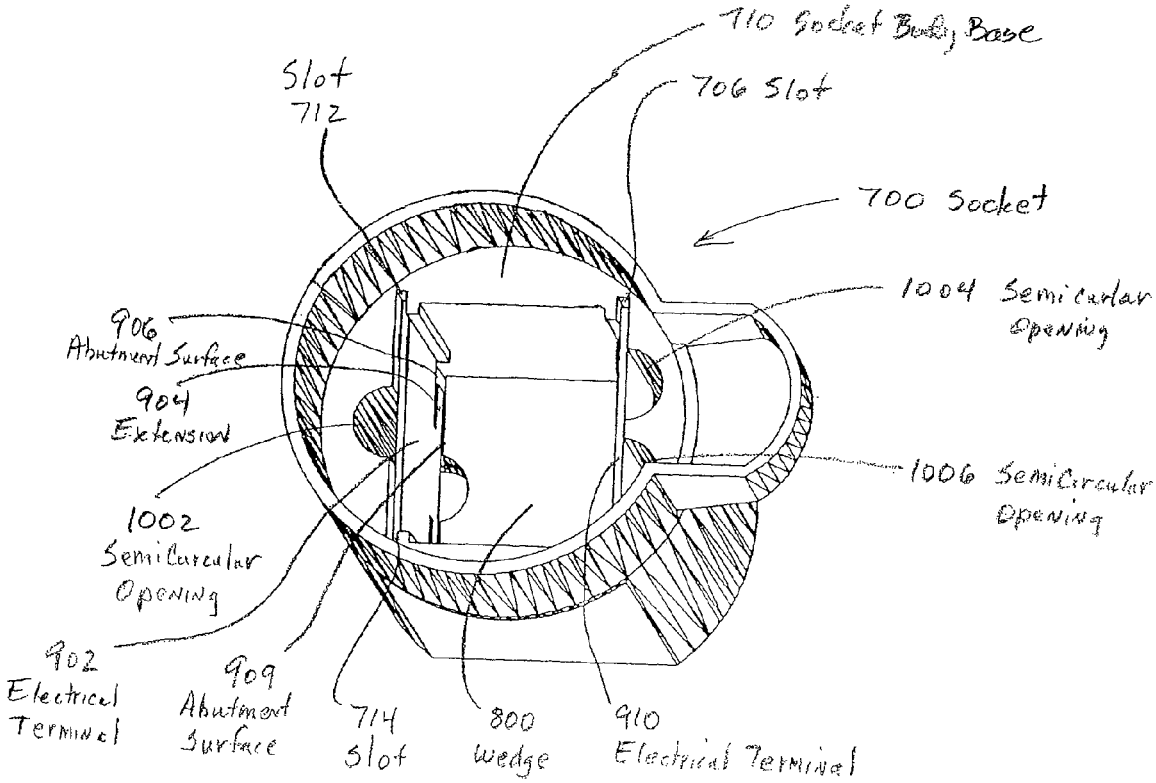
FIG. 10 is a top isometric view of the embodiment of a socket illustrated in FIG. 7.
Figure 13:
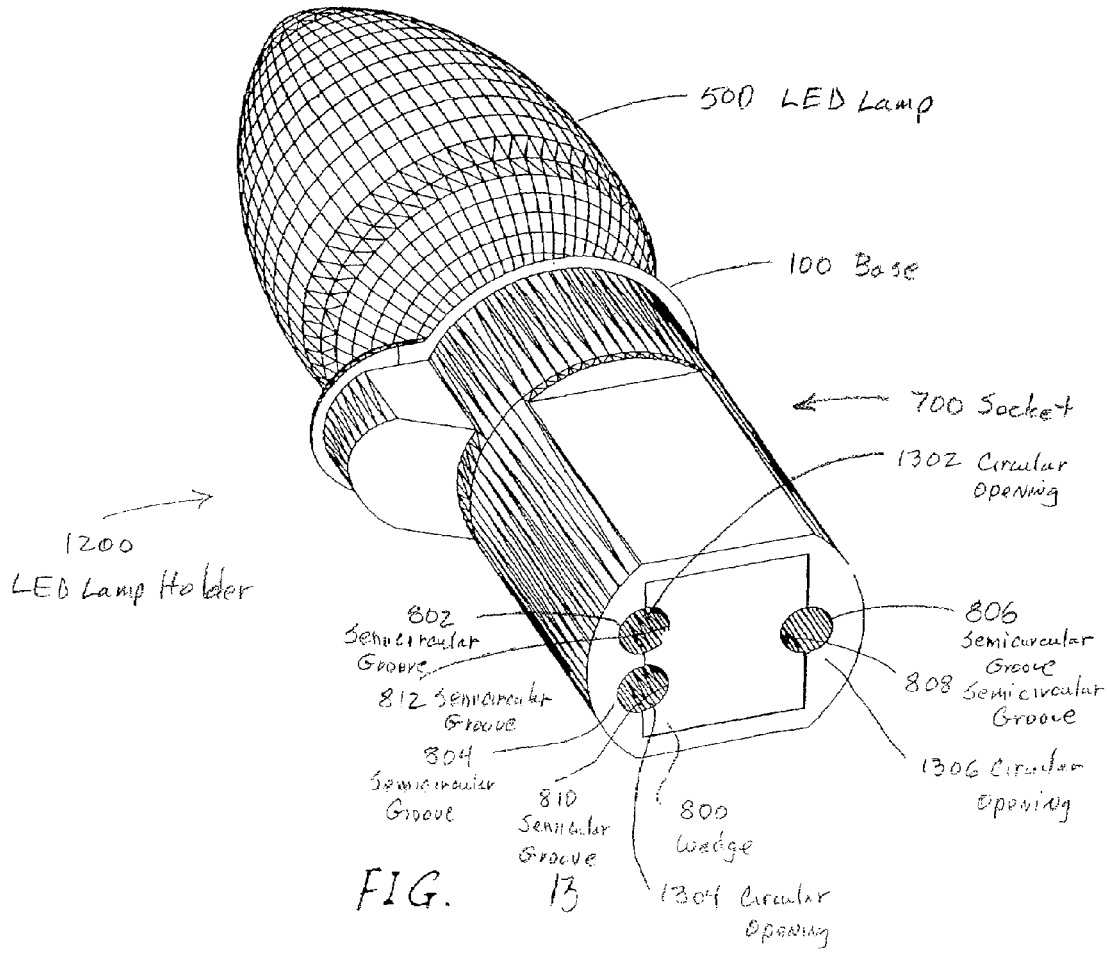
FIG. 13 is an isometric bottom view of the LED lamp assembled in one embodiment of an LED lamp holder comprising the base illustrated in FIG. 1 and the socket illustrated in FIG. 7.

FIG. 10 is a top isometric view of the socket 700. As shown in FIG. 10, electrical terminal 902 is inserted in slots 712, 714 formed in the socket body base 710. Abutment surface 906 and abutment surface 908 (FIG. 9) abut against the bend of the slots 712, 714, respectively. The extension 904 extends beyond the abutment surface 906 and has an abutment surface 909 which abuts against the wedge 800. The extension 904 allows the wedge to be inserted in the rectangular opening of the socket body base 710 to a point where it is flush with the bottom of the socket body base 710 as illustrated in FIG. 13. Electrical terminal 910 is inserted in slots 706, 708 similarly to electrical terminal 902. The semicircular opening 1002 is enclosed by the electrical terminal 902 as illustrated in FIG. 10. A wire inserted from the bottom of the socket body base 710 through the semicircular opening in the wedge 800 is held in the semicircular opening 1002 by the electrical terminal 902. The wire (not shown) exerts an inward force on the electrical terminal 902 towards the inner portion of the rectangular opening in the socket body base 710. Similarly, wires inserted in the semicircular opening 1004, 1006 are held in place by electrical terminal 910. The wires 1402-1406 (FIG. 14) generate an inward force on the electrical terminal 910 towards the interior of the rectangular opening in the socket body base 710.

Figure 11:
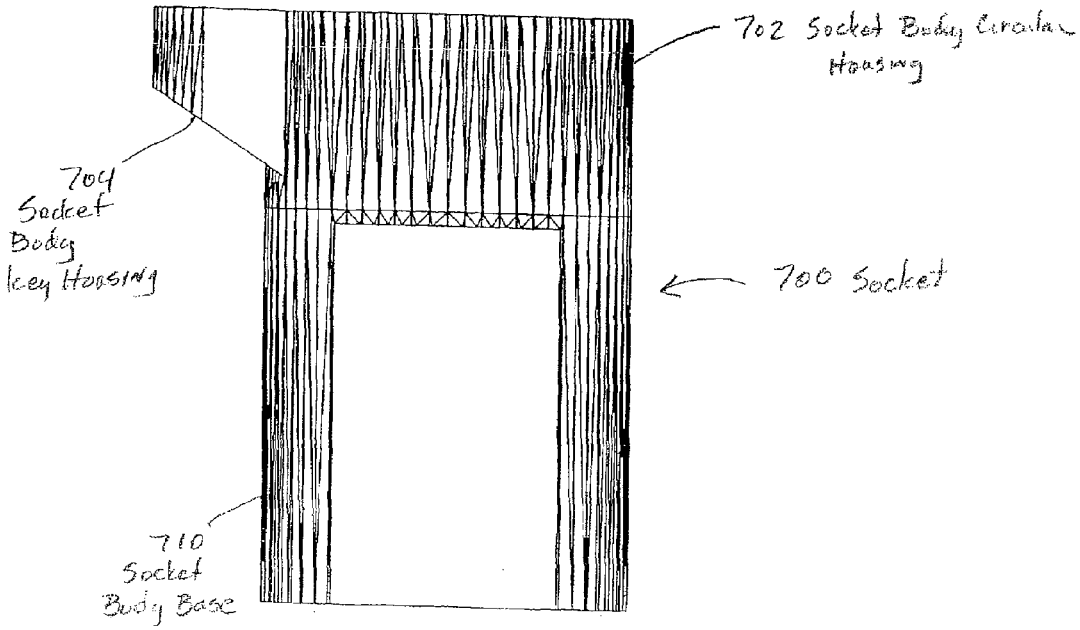
FIG. 11 is a side view of the socket illustrated in FIG. 7.

FIG. 11 is a side view of the socket 700. The socket 700 includes a socket body base 710, a socket body circular housing 702 and a socket body key housing 704. The socket 700 is made from a single, molded piece of plastic.

Figure 12:
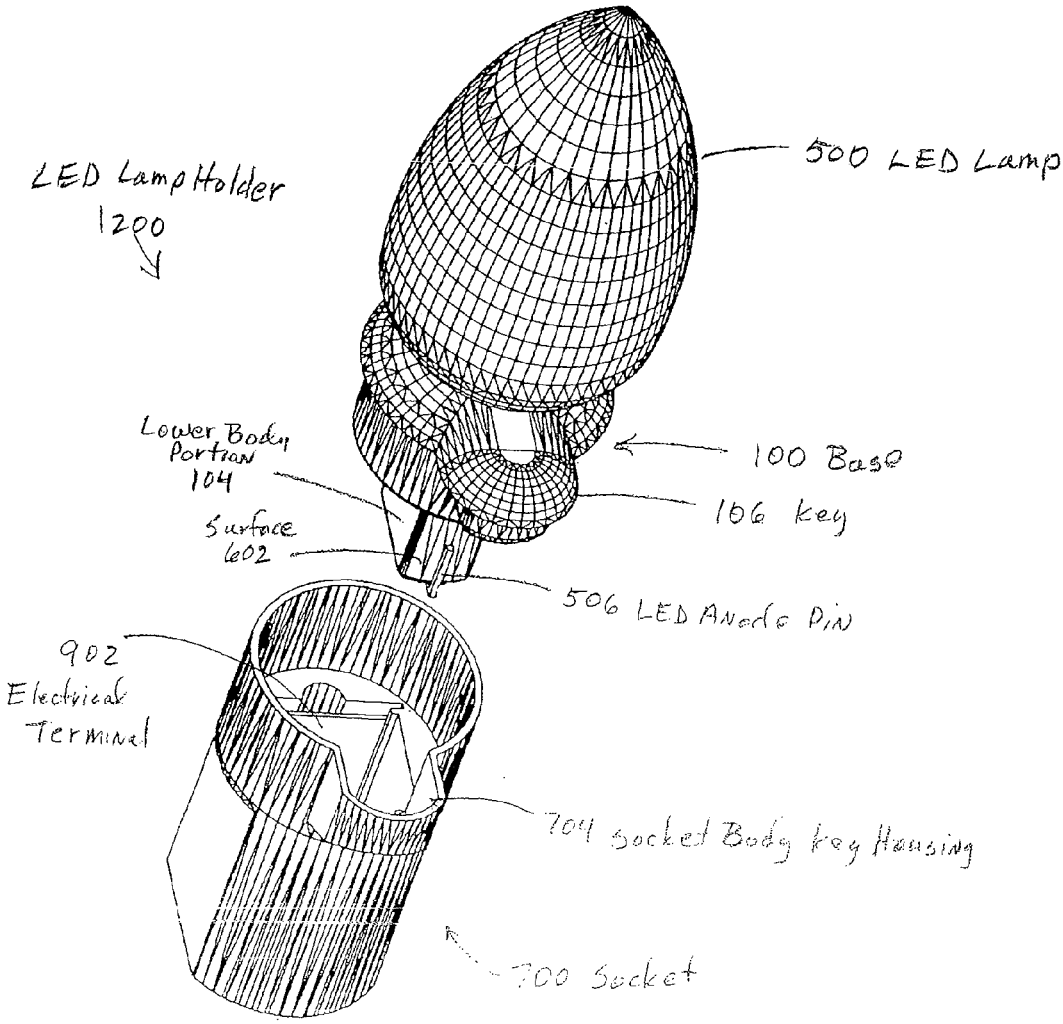
FIG. 12 is a top isometric view of an assembled LED lamp and base that is being assembled to the socket illustrated in FIG. 7.

FIG. 12 is an isometric assembly view of an LED lamp holder 1200. As shown in FIG. 12, the LED lamp 500 is assembled to the base 100. LED anode pin 506 is wrapped around a surface 1202 of the lower body portion 104. Electrical terminals such as electrical terminal 902 are inserted into the socket 700. The base 100 is then inserted into the socket 700 so that the key 106 is aligned with the socket body key housing 704 for proper orientation and alignment of the base 100 to the socket 700. The LED anode pin 506 and the lower body portion 104 exert an outward force on electrical terminal 910 (FIG. 10). This outward force is countered by an inward force created by wires disposed in semicircular openings 1004, 1006 (FIG. 10). An LED cathode pin (FIG. 6) is wrapped around surface 604 (FIG. 6). Surface 604 and the LED cathode pin 504 exert a force on electrical terminal 902 which is offset by a force created by a wire disposed in the semicircular opening 1002 (FIG. 10), which is created in a substantially opposite direction. The forces created on the electrical terminals 902, 910 in substantially opposite directions create a strong electrical connection between the LED anode pin 506 and the electrical terminal 910, as well as the LED cathode pin 504 and the electrical terminal 902. These forces, however, still allow the base 100 to be inserted into the socket 700 and to be removed from the socket 700 for replacement of the LED lamp 500. The LED lamp 500 can be replaced by unwrapping the LED cathode pin 504 from surface 604 and the LED anode pin 506 from surface 602 so that the LED cathode pin 504 and the LED anode pin 506 can be straightened and removed from the openings 106, 108, respectively, as shown in FIG. 6. A friction fit between the interior surface of the socket body cylindrical housing 702 (FIG. 7) and the outer surface of the cylindrical upper body portion 102 (FIG. 5) seals the base 100 to the socket 700, prevents water from entering the socket 700 and maintains the structural integrity of the assembled LED lamp holder 1200.

FIG. 13 is an isometric view of the assembled LED lamp holder 1200. As shown in FIG. 13, the LED lamp 500 is secured to the base 100. The socket 700 is also secured to the base 100. The wedge 800 is secured in the bottom of the socket 700. The semicircular groove 812 of the wedge 800 matches the semicircular groove 802 of the socket to form a circular opening 1302. Similarly, the semicircular groove 810 of the wedge 800 matches the semicircular groove 804 of the socket 700 to form a circular opening 1304. Semicircular groove 808 of the wedge 800 matches the semicircular groove 806 of the socket 700 to create a circular opening 1306. Wires (not shown) extend through the circular openings 1302, 1304, 1306 and are held securely by the socket 700 and wedge 800 to resist removal. Wedge 800 can be friction fit into the base of the socket 700, or it can be adhesively attached, heat welded or otherwise welded into the socket 700.

Figure 14:
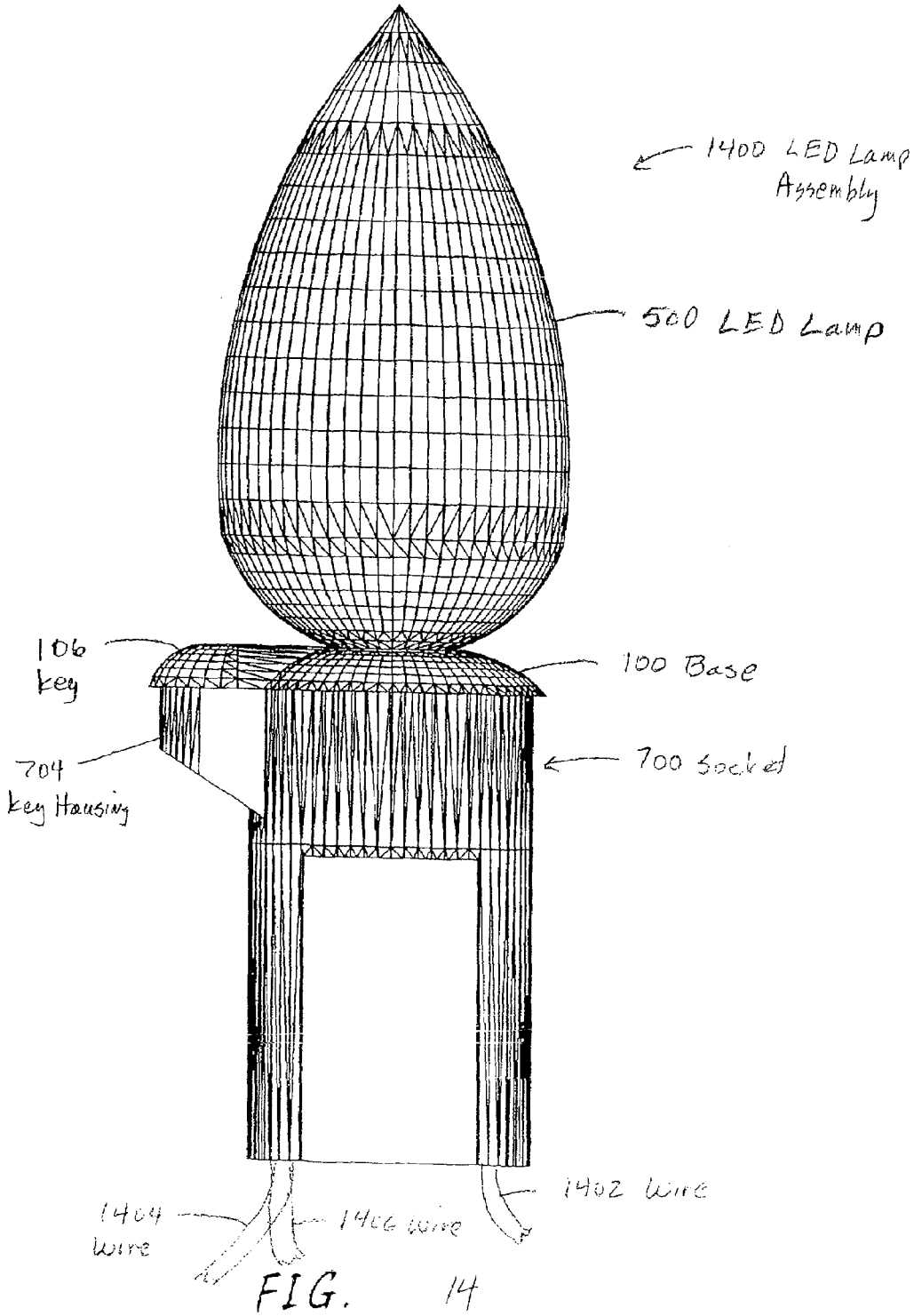
FIG. 14 is a side view of the embodiment illustrated in FIG. 13.

FIG. 14 is a side view of the LED lamp assembly 1400. The LED lamp assembly 1400 includes an LED lamp 500, a base 100 that includes a key 106, a socket 700 having a key housing 704 and wires 1404, 1406, 1402 that are secured in the socket 700 by wedge 800 (FIG. 13). The LED lamp assembly 1400 can be connected in a parallel configuration such that wires 1404, 1406 are both connected to a power source. Wire 1402 is connected to the next LED lamp.

Figure 15:
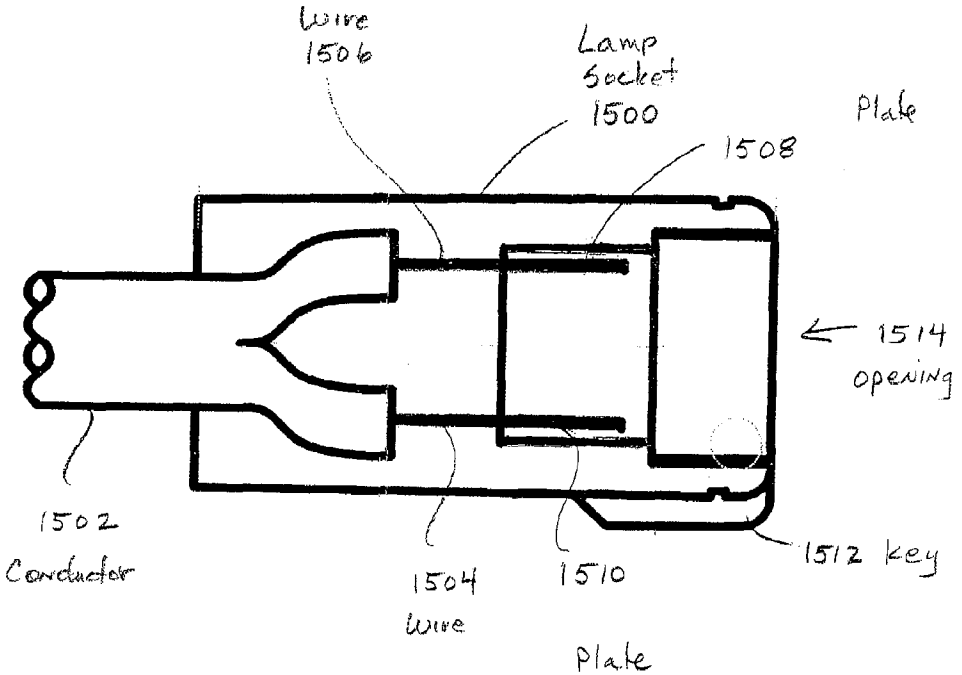
FIG. 15 is a cross-sectional view of an embodiment of a lamp holder.

FIGS. 15-25 disclose another embodiment of a lamp assembly. As illustrated in FIG. 15, lamp holder 1500 is coupled to a conductor 1502 that supplies power to the lamp holder 1500. Conductor 1502 may be connected to a light string, such as a decorative light string, or may be connected to other types of power sources. In other words, lamp holder 1500 can be used in various implementations other than light strings. The lamp holder 1500 may be made from a plastic type material, which can be overmolded on the conductor 1502 and other components illustrated in FIG. 15. Alternatively, lamp holder 1500 can be constructed separately from the conductor 1502 and later assembled with the conductor 1502. Conductor 1502 includes wires 1504, 1506 that are connected to conductive plates 1508, 1510, respectively. Conductive plates 1508, 1510 are mounted in an opening 1514 at the end of the lamp holder 1500 that is opposite to the conductor 1502. The conductive plates 1508, 1510 provide contact surfaces for LED leads of an LED element, as disclosed below. Key 1512 provides an indication of the polarity of the diode element that is inserted in the opening 1514.

Figure 16:
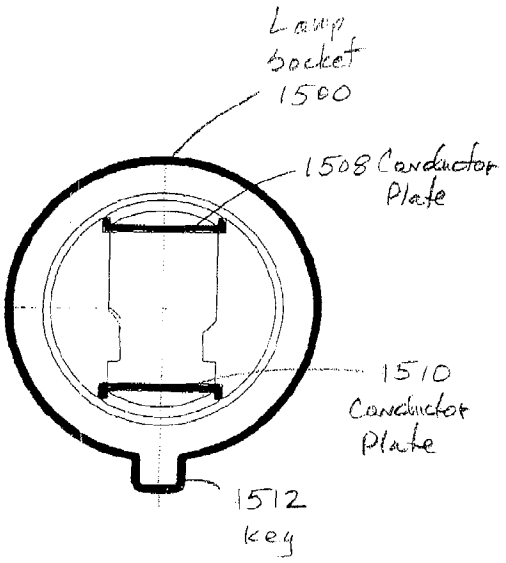
FIG. 16 is an end view of the lamp holder illustrated in FIG. 15.

FIG. 16 is an end view of the lamp holder 1500, as viewed from the opening 1514. As shown in FIG. 16, conductive plates 1508, 1510 provide a conductive surface for connection of the LED leads, as disclosed below. Opening 1514 has a predetermined shape that substantially matches the shape of the LED element, so that the LED element is inserted in the lamp holder 1500 with the correct polarity. In addition, key 1512 provides a visual indicator for the polarity of the lamp holder 1500.

Figure 17:
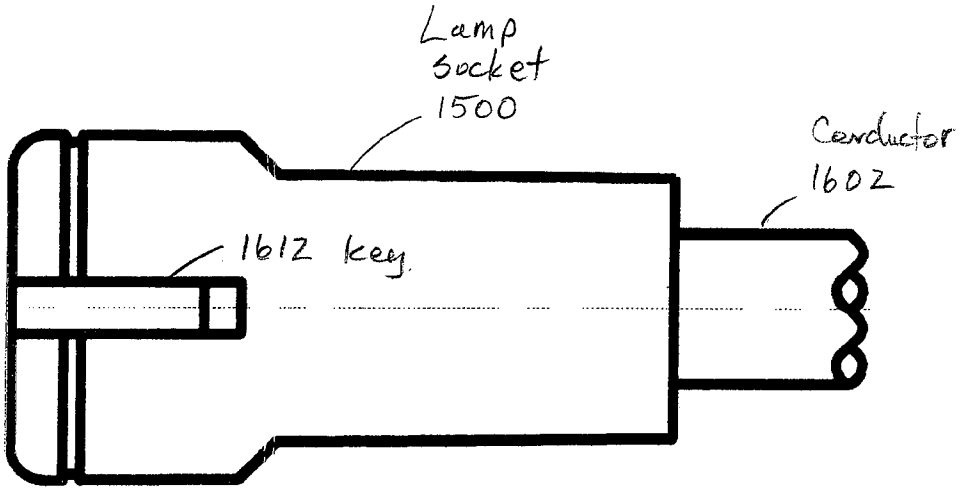
FIG. 17 is a bottom view of the lamp holder illustrated in FIGS. 15 and 16.

FIG. 17 is a side view of the lamp holder 1500. As shown in FIG. 17, key 1612 provides a visual indication of the polarity of the manner in which the conductor 1602 is connected to the lamp holder 1500.

Figure 18:
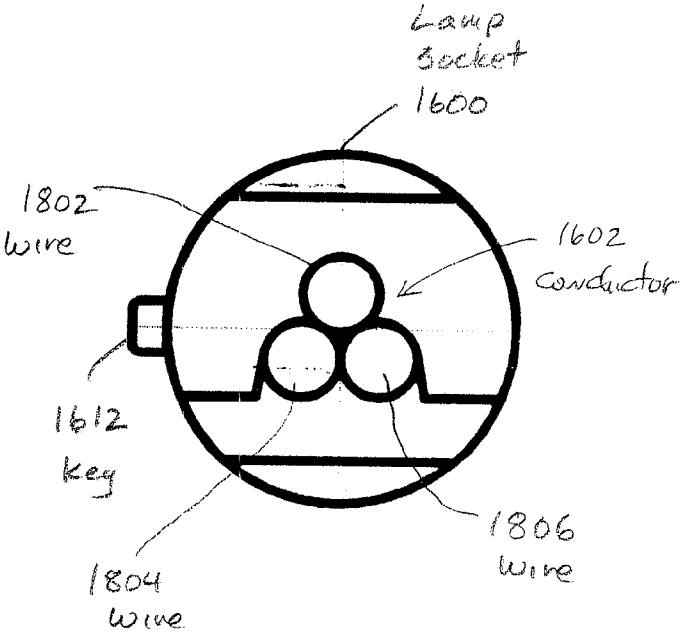
FIG. 18 is an end view of the lamp holder illustrated in FIG. 17.

FIG. 18 is a right side end view of the lamp holder 1500. As shown in FIG. 18, conductor 1602 may include three separate wires 1802, 1804, 1806 that are coupled to the lamp holder 1500. Three wires are required to connect the lamp holder 1500 in a parallel configuration to avoid darkening of the entire string when an LED burns open or is disconnected in a series wired light strings. The two-wire configuration of FIGS. 15 and 16 is utilized in a series wired configuration in a light string. Key 1612 indicates the polarity of the lamp holder 1500.

Figure 20:
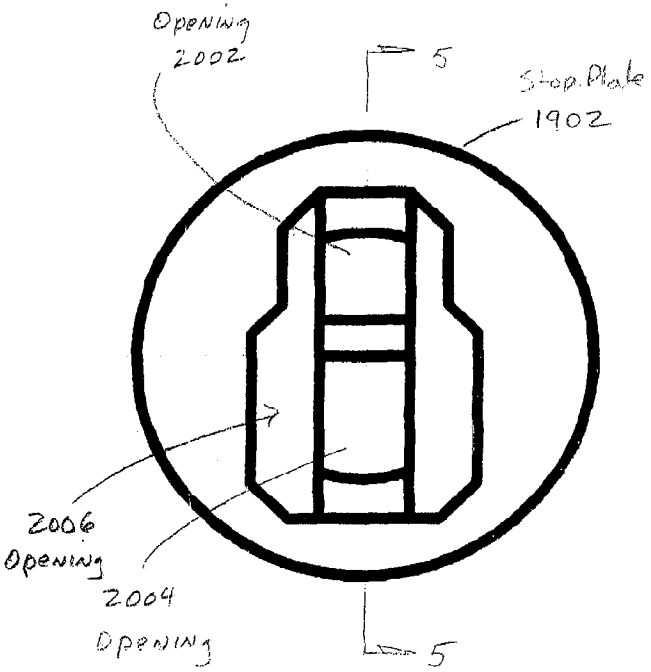
FIG. 20 is an end view of the socket of FIG. 19.
Figure 19:
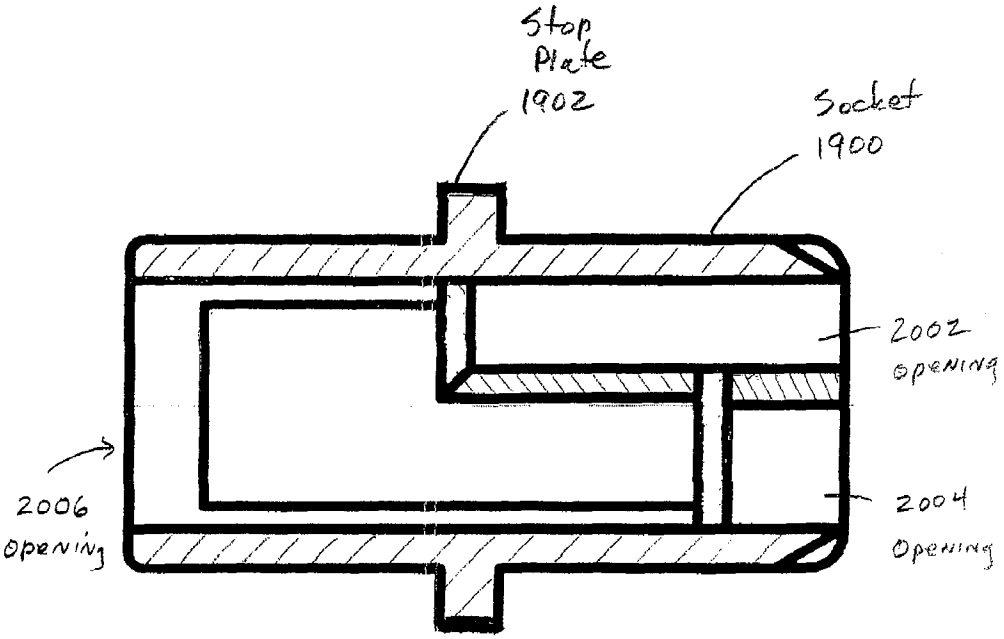
FIG. 19 is a cross-sectional view of an embodiment of a socket.

FIG. 19 is a cross-sectional view of FIG. 20, illustrating a socket 1900 that is adapted to be plugged into the lamp holder 1500. Socket 1900 includes a stop plate 1902 that abuts against a surface, as disclosed below, in the lamp holder 1500.

Socket 1900 has an opening 2006 at one end and a pair of openings 2002 and 2004 at the other end of the socket 1900.

FIG. 20 is an end view of the socket 1900. As shown in FIG. 20, stop plate 1902 has a round configuration and is disposed around the periphery of the socket 1900. Openings 2002, 2004, 2006 are also illustrated in FIG. 20.

Figure 21:
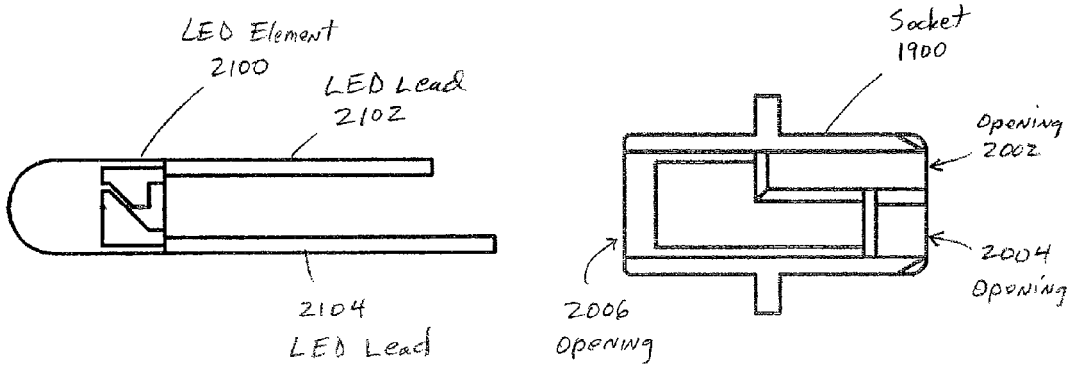
FIG. 21 is an assembly view of the socket of FIG. 19 and an LED element.

FIG. 21 is an assembly drawing of an LED element 2100 and socket 1900. As shown in FIG. 21, LED element 2100 has LED leads 2102, 2104. LED leads 2102, 2104 are inserted in opening 2106 of socket 1900. LED leads 2102, 2104 extend through the center portion of the socket 1900 so that LED lead 2102 extends through opening 2002, while LED lead 2104 extends through opening 2004. Socket 1900, as pointed out above, is adapted to fit into the lamp holder 1500.

Figure 22:
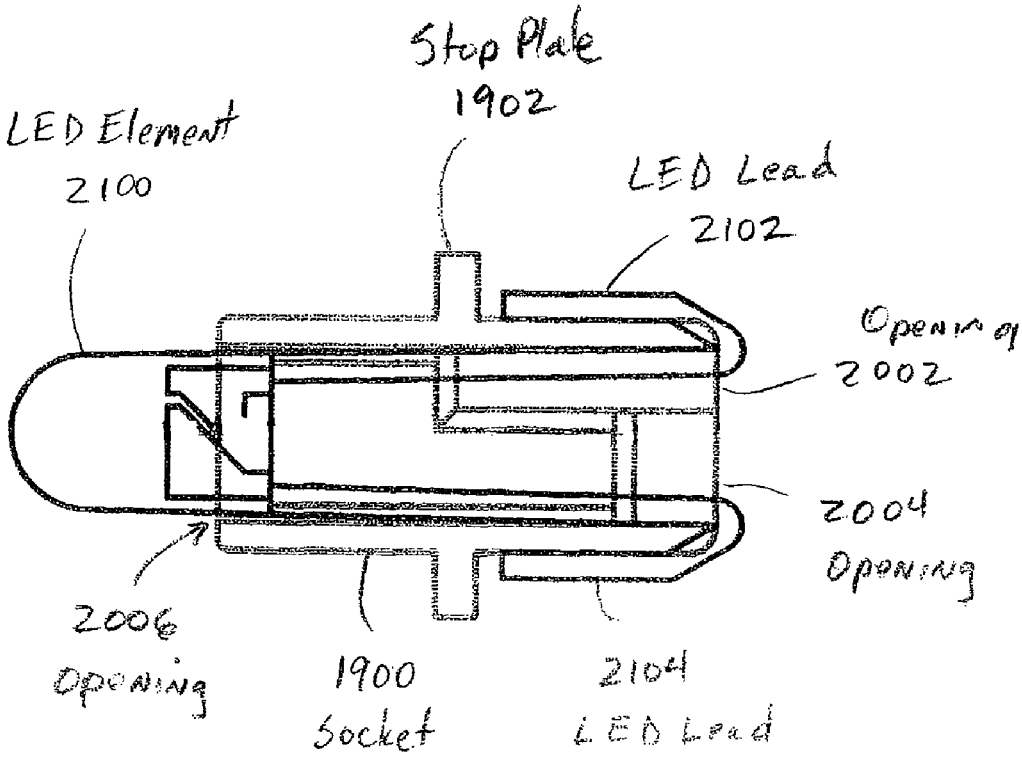
FIG. 22 is a schematic illustration of an embodiment of an assembled LED element and socket.

FIG. 22 is an illustration of the LED element 2100 that is assembled to the socket 1900. As illustrated in FIG. 22, the LED element 2100 fits into the opening 2106 in a specified orientation, based upon the shape of the opening 2006, as illustrated in FIG. 20. LED element 2100 has a shape that fits in the opening 2006, as illustrated in FIG. 20 in a particular orientation, so that the proper polarity of the LED element 2100 is maintained in the socket 1900. As indicated above, LED lead 2102 extends through opening 2002 and is wrapped around the outer surface of the extended portion 1904 of socket 1900. Similarly, LED lead 2104 extends through opening 2004 and also wraps around the outside of the extended portion 1904 of socket 1900. In this manner, the LED leads 2102, 2104 are forced outwardly by the extended portion 1904 of the socket 1900 and the modulus of elasticity of the LED leads 2102, 2104 additionally causes the leads to be forced in an outward direction away from the extended portion 1904. The metal selected for the LED leads 2102, 2104 can provide a sufficient amount of elasticity, or springiness, to cause the LED leads 2102, 2104 to generate an outward force away from the extended portion 1904.

Figure 23:
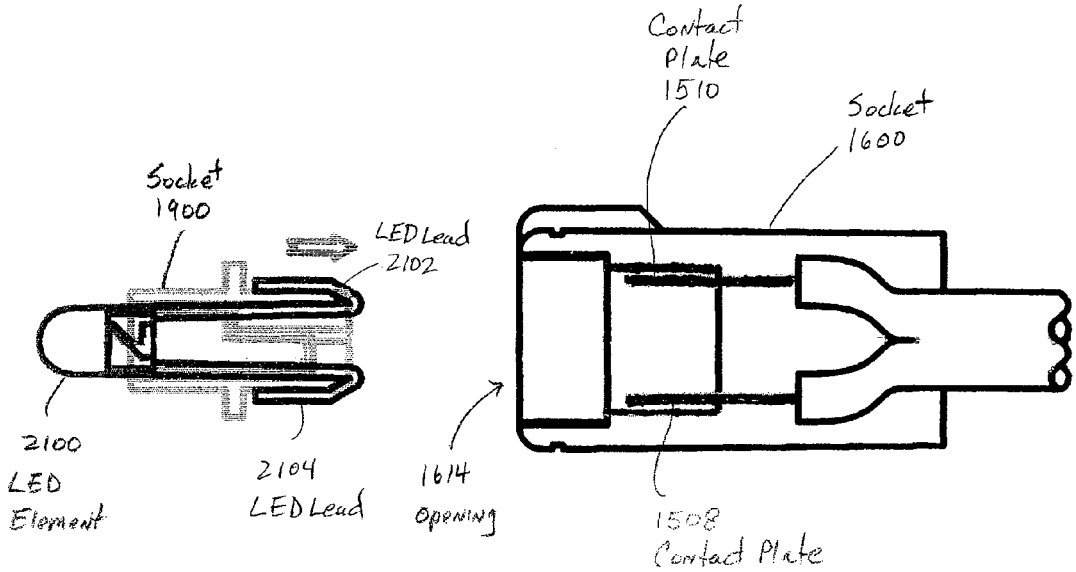
FIG. 23 is an assembly view of the lamp holder of FIG. 15 and the socket and LED element illustrated in FIG. 22.

FIG. 23 is an assembly drawing of the socket 1900 and the lamp holder 1500. As shown in FIG. 23, the assembled LED element 2100 and socket 1900 is inserted in the opening 1614 of the lamp holder 1500. LED leads 2102, 2104 are adapted to be placed adjacent to contact plates 1510, 1508, respectively, in lamp holder 1500. The extended portion 1904 has the same shape as the opening 1614, so that the socket 1900 fits into the lamp holder 1500 in the proper orientation with the proper polarity.

Figure 24:
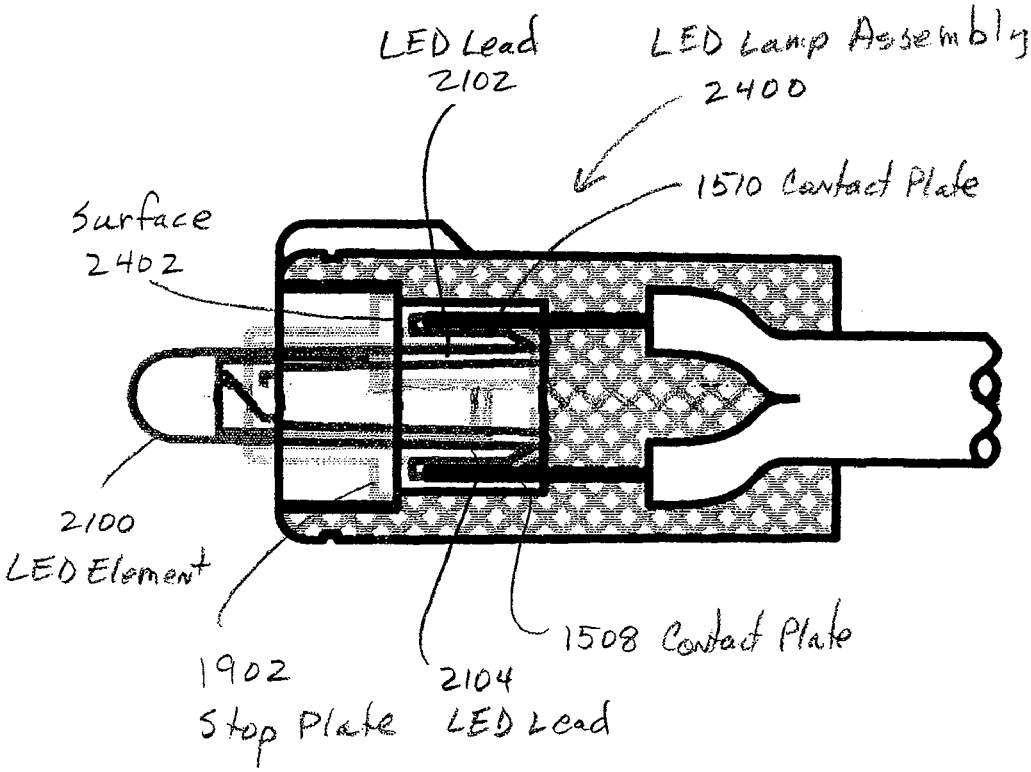
FIG. 24 is a cross-sectional view of an LED lamp assembly.

FIG. 24 illustrates the LED lamp assembly 2400 that includes the assembled socket 1900 and LED element 2100 that is disposed in the lamp holder 1500. As shown in FIG. 24, the stop plate 1902 on the socket 1900 abuts against the surface 2402 of the lamp holder 1500. LED lead 2102 abuts against the contact plate 1510 so that a firm electrical contact is made between the LED lead 2102 and the contact plate 1510, as a result of the pressure asserted by the bent LED lead 2102. Similarly, LED lead 2104 abuts against the contact plate 1508 to make a firm electrical contact. The opening provided between the contact plates 1510, 1508 is sized to provide a friction fit between the LED leads 2102, 2104 and contact plates 1510, 1508. The modulus of elasticity of the LED leads 2102, 2104 causes the LED leads to push against the contact plates 1510, 1508. In addition, the friction fit results in the extended portion 1904 generating a force in an outward direction, causing the LED leads 2102, 2104 to be forced against the contact plates 1510, 1508. In this manner, a secure and full contact surface is created between the LED leads 2102, 2104 and contact plates 1510, 1508, respectively. Of course, the socket 1900 can be removed from the lamp holder 1500 to replace the LED element 2100 if the LED element 2100 burns out or is otherwise defective.

Figure 25:
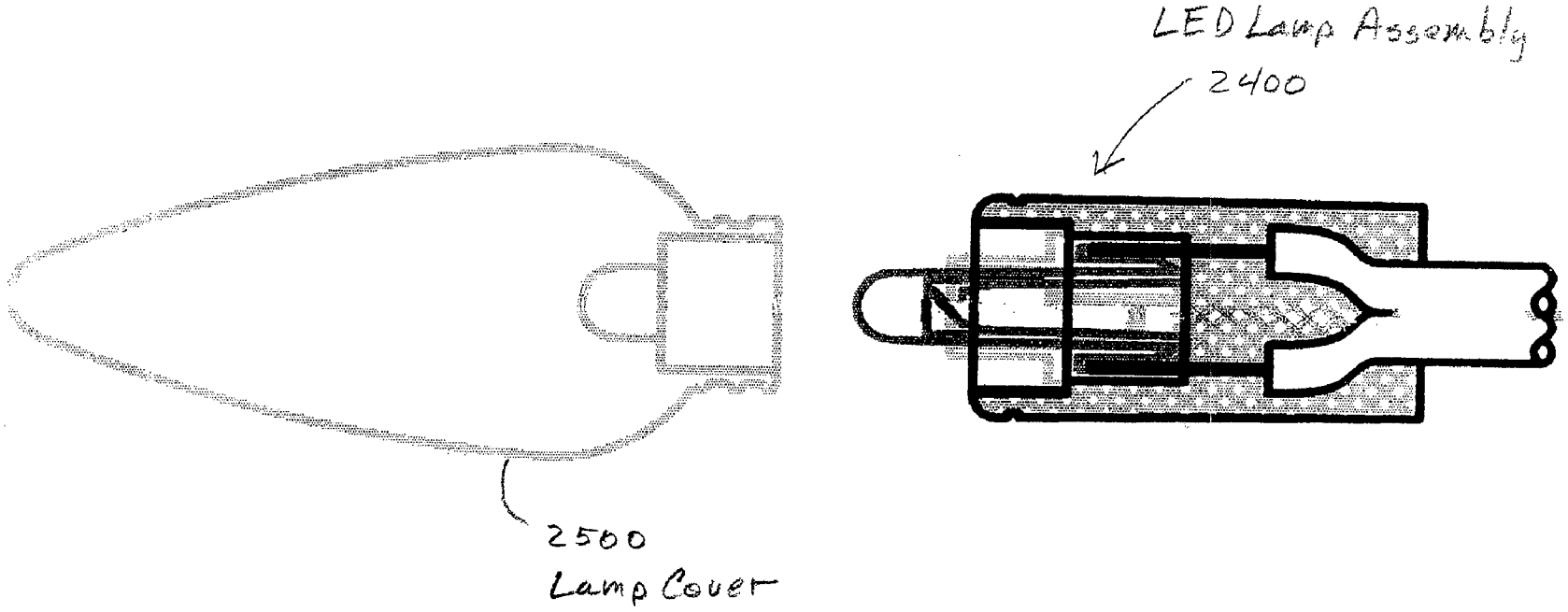
FIG. 25 is an assembly drawing of the LED lamp assembly and a lamp cover.

FIG. 25 is an assembly drawing illustrating the manner in which a lamp cover 2500 can be attached to LED lamp assembly 2400. As shown in FIG. 25, the neck 2502 of the lamp cover 2500 is inserted in the opening 1514 of the LED lamp assembly 2400. The LED element 2100 extends through the opening 2504 to the interior portion of the lamp cover 2500, so that light emissions from the LED element 2100 project through the lamp cover 2500. The neck 2502 can be secured to the LED lamp assembly 2400 with a friction fit, or in other ways, such as disclosed in U.S. patent application Ser. No. 11/957,294, filed on Dec. 14, 2007 by Jing Jing Yu, entitled Substantially Inseparable Led Lamp Assembly (permanently sealed LED lamp application), which is specifically incorporated herein by reference for all that it discloses and teaches.

Hence, the embodiment disclosed in FIGS. 15-25 utilizes a separate socket that holds an LED element that is plugged into a lamp holder. This two part construction technique allows the LED element to be separately secured to the socket prior to insertion into a lamp holder. The socket provides stability for the LED element and allows the LED leads 2102, 2104 to be securely and conductively connected to conductive plates 1510, 1508 in the lamp holder 1500, while still allowing the socket 1900 to be removed from the lamp holder 1500. Further, the LED element 2100 has a specific shape that fits into the socket and the socket has a specific shape that is adapted to fit into the lamp holder, so that proper polarity is maintained for the LED element.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A water resistant LED lamp assembly for releasably attaching an LED element to a power connection comprising:

an LED element comprising a lamp base having a predetermined shape;

a lamp holder having a body portion, said body portion having a lamp holder opening formed in said body portion having a predetermined shape, so that said lamp base fits in said lamp holder body in a manner that provides a water resistant seal;

a socket comprising an extended portion that has a shape that substantially matches said predetermined shape of said opening formed in said body portion of said lamp holder, said socket formed to have a socket opening that has a shape that substantially matches said predetermined shape of said lamp base, so that a friction fit is created between said socket and said body portion of said lamp holder that provides a water resistant seal;

two terminal plates disposed on opposite sides of said body portion of said lamp holder;

a pair of LED pins that extend through a central opening in said socket that are bent around an outside surface of said extended portion of said socket so that said two LED pins abut against said two terminal plates to make an electrical contact when said socket is inserted in said lamp housing as a result of said extended portion forcing said LED pins in an outward direction against said terminal plates, said LED pins having a modulus of elasticity that causes said LED pins to push against said terminal plates with a sufficient force to create a solid electrical connection with said terminal plates while allowing said socket to be removed from said lamp holder;

a wedge securely attached on a lower portion of said socket to create a water resistant seal around power wires entering said LED lamp assembly.

2. The LED lamp assembly of claim 1 wherein said socket further comprises:

a stop plate that limits the distance that said socket can be inserted into said lamp housing.

3. The LED lamp assembly of claim 2 further comprising:

a pair of wires connected to said power connection and to said two terminal plates.

4. A method of releasably connecting an LED element to an AC power source comprising:

providing a lamp holder comprising two conductive plates that are connected to said power source and a lamp holder opening having a predetermined shape;

providing an LED element that has a predetermined LED shape and two LED pins;

providing a socket that has an extended portion having a shape that substantially matches said predetermined shape of said lamp holder opening, and a socket opening having a shape that substantially matches said predetermined LED shape;

inserting said LED lamp into said socket so that said predetermined LED shape fits into said socket opening;

inserting said LED pins through a central opening in said socket;

bending portions of said LED pins that extend from said socket around said outside surface of said extended portion of said socket so that said LED element can be removed from said socket;

inserting said extended portion of said socket into said lamp holder opening, said extended portion having a size that forces said LED pins against said conductive plates to create a solid electrical connection while allowing said LED pins to be removed from said socket, said LED pins having a modulus of elasticity that forces said LED pins outwardly in substantially opposite directions against said conductive plates to create a solid electrical connection while allowing said socket and said LED pins to be removed from said lamp holder.

5. The method of claim 4 further comprising:

connecting said two conductive plates to wires that are connected to said AC power source.

6. The method of claim 5 wherein said process of inserting said extended portion of said socket in said lamp holder comprises:

inserting said extended portion of said socket in said lamp holder until a stop plate on said socket abuts against a surface in said lamp holder opening.

* * * * *